US006264678B1

(12) United States Patent
Landers

(10) Patent No.: US 6,264,678 B1
(45) Date of Patent: Jul. 24, 2001

(54) VIBRATING PACIFIER

(75) Inventor: Sonny B. Landers, Stockton, CA (US)

(73) Assignee: Pete Beltrama, Stockton, CA (US)

( * ) Notice: Subject to any disclaimer, the term of this patent is extended or adjusted under 35 U.S.C. 154(b) by 18 days.

(21) Appl. No.: 09/621,980

(22) Filed: Jul. 21, 2000

(51) Int. Cl.[7] ..... A61J 17/00
(52) U.S. Cl. ..... 606/236; 606/234
(58) Field of Search ..... 606/234, 235, 606/236; D24/194, 195, 196, 197, 198; 601/46, 67, 80, 139, 140, 141, 142

(56) References Cited

U.S. PATENT DOCUMENTS

D. 303,839 10/1989 Fitzpatrick et al. .
3,115,139 * 12/1963 Schneider .
5,551,952 9/1996 Falgout .
5,581,238 12/1996 Chang et al. .
5,649,964 7/1997 Berman et al. .
5,693,073 12/1997 Glick et al. .
5,902,322 5/1999 Scagliotti .

* cited by examiner

*Primary Examiner*—David O. Reip

(57) ABSTRACT

A vibrating pacifier for providing increased comfort to teething child in particular. The vibrating pacifier includes a body having a cavity therein and also having a front end, a back end, and a mouth guard portion extending about the body; and also includes a nipple member disposed at and extending from the front end of the body; and further includes a handle member rotatably and sealingly mounted to the body near the back end thereof; and also includes a vibrating assembly for vibrating the nipple member.

8 Claims, 2 Drawing Sheets

VIBRATING PACIFIER

BACKGROUND OF THE INVENTION

1. Field of the Invention

The present invention relates to a pacifier device and more particularly pertains to a new vibrating pacifier for providing increased comfort to teething child in particular.

2. Description of the Prior Art

The use of a pacifier device is known in the prior art. More specifically, a pacifier device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,693,073; U.S. Pat. No. 5,581,238; U.S. Pat. No. 5,902,322; U.S. Pat. No. 5,551,952; U.S. Pat. No. 5,649,964; and U.S. Pat. No. Des. 303,839.

While these devices fulfill their respective, particular objectives and requirements, the aforementioned patents do not disclose a new vibrating pacifier. The inventive device includes a body having a cavity therein and also having a front end, a back end, and a mouth guard portion extending about the body; and also includes a nipple member disposed at and extending from the front end of the body; and further includes a handle member rotatably and sealingly mounted to the body near the back end thereof; and also includes a vibrating assembly for vibrating the nipple member.

In these respects, the vibrating pacifier according to the present invention substantially departs from the conventional concepts and designs of the prior art, and in so doing provides an apparatus primarily developed for the purpose of providing increased comfort to teething child in particular.

SUMMARY OF THE INVENTION

In view of the foregoing disadvantages inherent in the known types of pacifier device now present in the prior art, the present invention provides a new vibrating pacifier construction wherein the same can be utilized for providing increased comfort to teething child in particular.

The general purpose of the present invention, which will be described subsequently in greater detail, is to provide a new vibrating pacifier which has many of the advantages of the pacifier device mentioned heretofore and many novel features that result in new vibrating pacifier which is not anticipated, rendered obvious, suggested, or even implied by any of the prior art pacifier device, either alone or in any combination thereof.

To attain this, the present invention generally comprises a body having a cavity therein and also having a front end, a back end, and a mouth guard portion extending about the body; and also includes a nipple member disposed at and extending from the front end of the body; and further includes a handle member rotatably and sealingly mounted to the body near the back end thereof; and also includes a vibrating assembly for vibrating the nipple member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vibrating pacifier which has many of the advantages of the pacifier device mentioned heretofore and many novel features that result in a new vibrating pacifier which is not anticipated, rendered obvious, suggested, or even implied by any of the prior art pacifier device, either alone or in any combination thereof.

It is another object of the present invention to provide a new vibrating pacifier which may be easily and efficiently manufactured and marketed.

It is a further object of the present invention to provide a new vibrating pacifier which is of a durable and reliable construction.

An even further object of the present invention is to provide a new vibrating pacifier which is susceptible of a low cost of manufacture with regard to both materials and labor, and which accordingly is then susceptible of low prices of sale to the consuming public, thereby making such vibrating pacifier economically available to the buying public.

Still yet another object of the present invention is to provide a new vibrating pacifier which provides in the apparatuses and methods of the prior art some of the advantages thereof, while simultaneously overcoming some of the disadvantages normally associated therewith.

Still another object of the present invention is to provide a new vibrating pacifier for providing increased comfort to teething child in particular.

Yet another object of the present invention is to provide a new vibrating pacifier which includes a body having a cavity therein and also having a front end, a back end, and a mouth guard portion extending about the body; and also includes a nipple member disposed at and extending from the front end of the body; and further includes a handle member rotatably and sealingly mounted to the body near the back end thereof; and also includes a vibrating assembly for vibrating the nipple member.

Still yet another object of the present invention is to provide a new vibrating pacifier that massages and soothes the gums of the child to essentially relieve the pain associated with teething.

Even still another object of the present invention is to provide a new vibrating pacifier that reduces the amount of fuss by the child during the teething process.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
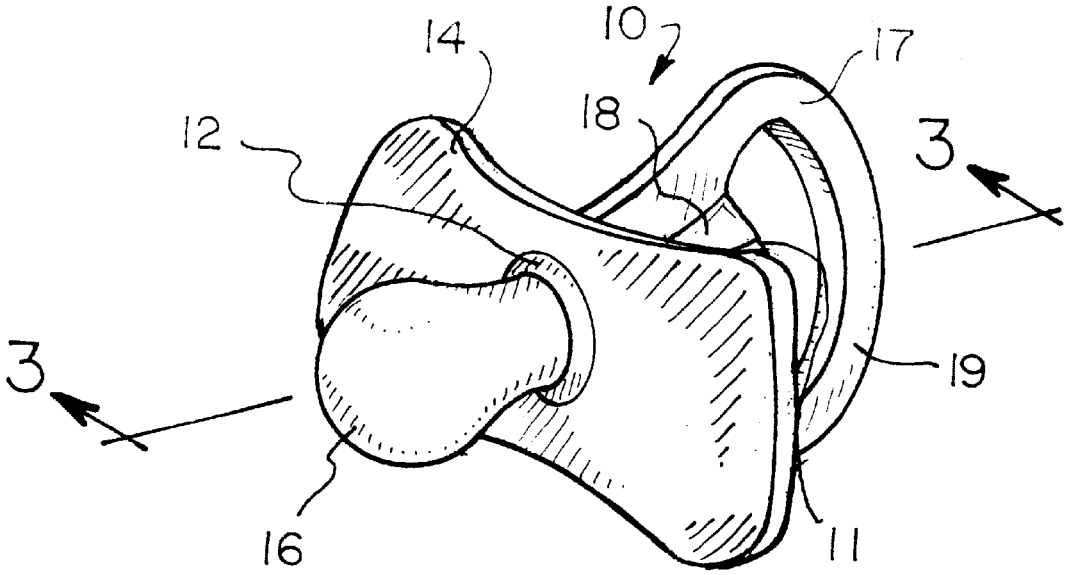
FIG. 1 is a perspective view of a new vibrating pacifier according to the present invention.
Figure 2:
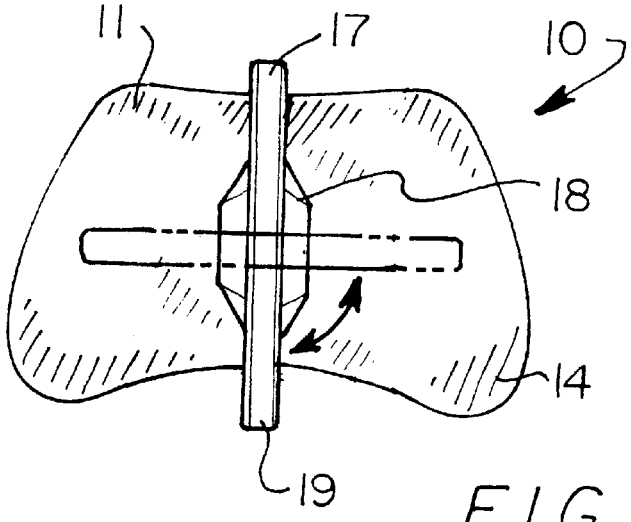
FIG. 2 is a rear elevational view of the present invention.
Figure 3:
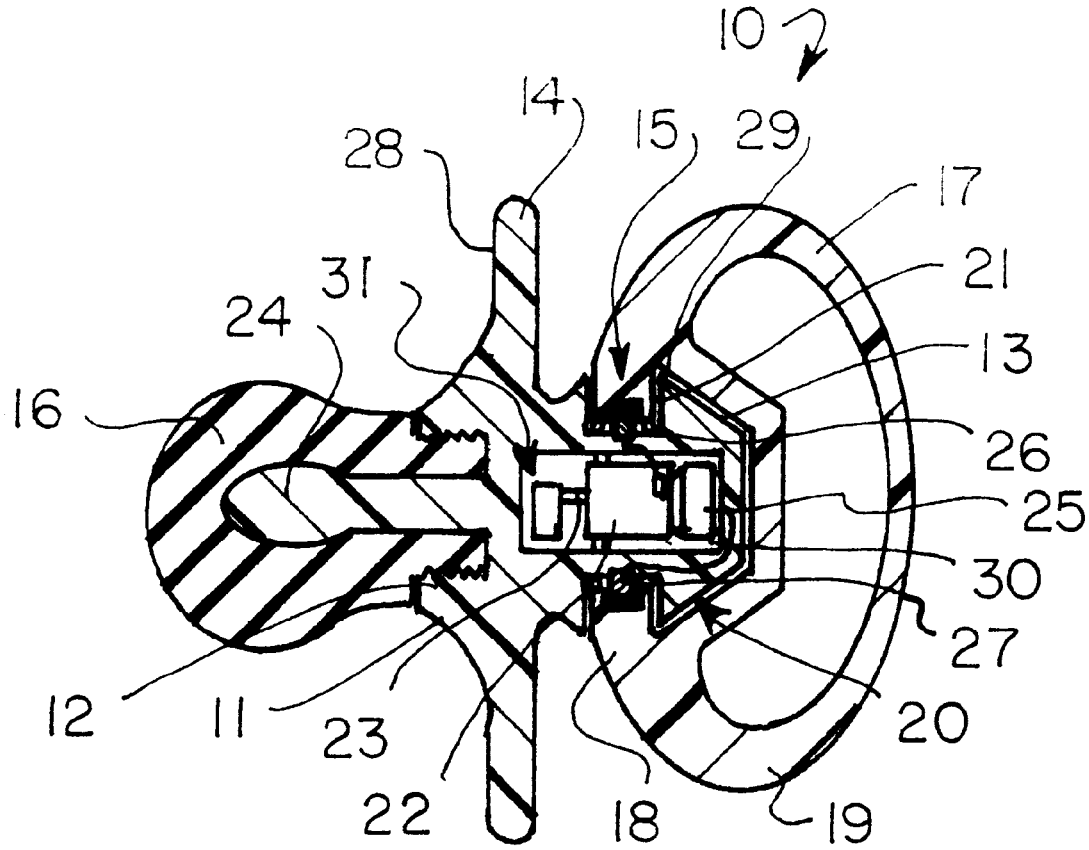
FIG. 3 is a cross-sectional view of the present invention.

With reference now to the drawings, and in particular to FIGS. 1 through 3 thereof, a new vibrating pacifier embodying the principles and concepts of the present invention and generally designated by the reference numeral 10 will be described.

As best illustrated in FIGS. 1 through 3, the vibrating pacifier 10 generally comprises a body 11 having a cavity 31 therein and also having a front end 12, a back end 13, and a mouth guard portion 14 integrally extending about the body 11. The body 11 includes a circumferentially-extending groove 15 disposed in a wall thereof intermediate of the mouth guard portion 14 and the back end 13 thereof. A nipple member 16 is securely and conventionally disposed at and extending from the front end 12 of the body 11.

A handle member 17 is rotatably and sealingly mounted to the body 11 near the back end 13 thereof. The handle member 1 7 includes a front end portion 18 and a back end portion 19 and also includes a recessed portion 20 disposed in the front end portion 18 and further includes an annular flange member 21 being integrally attached to the handle member 17 and extending inwardly of the recessed portion 20 and being securely received in the groove 15 for retaining the handle member 17 to the body 11. The back end portion 19 of the handle member 17 is essentially a ring-like portion being adapted to be grasped by person.

A means for vibrating the nipple member 16 includes a motor 22 having a motor shaft 23 and being conventionally disposed in the cavity 31 of the body 11, and also includes a battery 25 removably and conventionally disposed in the cavity 3 1 of the body 11 and being connected to the motor 22 with wires 30, and further includes an offset counterweight member 24 being connected to the motor shaft 23 for rotation thereof and being conventionally disposed in the nipple member 16 for vibration thereof, and also includes a first switch contact member 26 securely and conventionally attached to a surface of the annular flange 21 and being conventionally connected to the battery 25 and the motor 22, and further includes a second switch contact member 27 being securely and conventionally disposed in the groove 15 and being conventionally connected to the battery 25 and the motor 22 and being in contactable relationship with the first switch contact member 26 for the energizing of the motor 22, and also includes seal members 28,29 being conventionally disposed in the groove 15 between the flange member 21 and the body 11 for preventing moisture from entering the cavity 31 of the body 11. The first switch contact member 26 is essentially a ring-like member, and the seal members 28,29 are essentially O-rings.

In use, the user rotates the handle member 17 relative to the body 11 so that the first switch contact member 26 comes into contact with the second switch contact member 27 which energizes the motor 22 and causes the offset counterweight member 24 to rotate and vibrate the nipple member 16. To de-energize the motor 22, the user rotates the handle member 16 so that the first switch contact member 26 is not in contact with the second switch contact member 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vibrating pacifier comprising:

a body having a cavity therein and also having a front end, a back end, and a mouth guard portion extending about said body;

a nipple member disposed at and extending from said front end of said body;

a handle member rotatably and sealingly mounted to said body near said back end thereof; and a means for vibrating said nipple member, whereby said means for vibrating said nipple member may be selectively activated by a rotation of said handle member.

2. A vibrating pacifier as described in claim 1, wherein said body includes a circumferentially-extending groove disposed in a wall thereof intermediate of said mouth guard portion and said back end thereof.

3. A vibrating pacifier as described in claim 2, wherein said handle member includes a front end portion and a back end portion and also includes a recessed portion disposed in said front end portion and further includes an annular flange member being securely attached to said handle member and extending inwardly of said recessed portion and being securely received in said groove.

4. A vibrating pacifier as described in claim 3, wherein said back end portion is essentially a ring-like portion being adapted to be grasped by person.

5. A vibrating pacifier as described in claim 4, wherein said means for vibrating said nipple member includes a motor having a motor shaft and being disposed in said cavity of said body, a battery removably disposed in said cavity of said body and being connected to said motor, an offset counterweight member being connected to said motor shaft for rotation therewith and being disposed in said nipple member for vibrating thereof, a first switch contact member securely attached to said annular flange and being connected to said battery and said motor, a second switch contact member being securely disposed in said groove and being connected to said battery and said motor and being in contactable relationship with said first switch contact member for the energizing of said motor, and seal members disposed in said groove between said flange member and said body for preventing moisture from entering said cavity of said body.

6. A vibrating pacifier as described in claim 5, wherein said first switch contact member is essentially a ring-like member.

7. A vibrating pacifier as described in claim 6, wherein said seal members are essentially O-rings.

8. A vibrating pacifier comprising:

a body having a cavity therein and also having a front end, a back end, and a mouth guard portion extending about said body, said body including a circumferentially-extending groove disposed in a wall thereof intermediate of said mouth guard portion and said back end thereof;

a nipple member disposed at and extending from said front end of said body;

a handle member rotatably and sealingly mounted to said body near said back end thereof, said handle member including a front end portion and a back end portion and also including a recessed portion disposed in said front end portion and further including an annular flange member being securely attached to said handle member and extending inwardly of said recessed portion and being securely received in said groove, said back end portion being essentially a ring-like portion being adapted to be grasped by person; and a means for vibrating said nipple member including a motor having a motor shaft and being disposed in said cavity of said body, a battery removably disposed in said cavity of said body and being connected to said motor, an offset counterweight member being connected to said motor shaft for rotation therewith and being disposed in said nipple member for vibrating thereof, a first switch contact member securely attached to said annular flange and being connected to said battery and said motor, a second switch contact member being securely disposed in said groove and being connected to said battery and said motor and being in contactable relationship with said first switch contact member for the energizing of said motor, and seal members disposed in said groove between said flange member and said body for preventing moisture from entering said cavity of said body, said first switch contact member being essentially a ring-like member, said seal members being essentially O-rings.

* * * * *